United States Patent [19]

Slavin et al.

[11] Patent Number: 4,892,195

[45] Date of Patent: Jan. 9, 1990

[54] RECLOSABLE BOOK-LIKE PACKAGE

[75] Inventors: Daniel J. Slavin, Crystal Lake; John R. Kreider, Carol Stream, both of Ill.

[73] Assignee: Dordan Manufacturing Co., Chicago, Ill.

[21] Appl. No.: 202,700

[22] Filed: Jun. 3, 1988

[51] Int. Cl.[4] ..... B65D 1/24

[52] U.S. Cl. ..... 206/473; 206/459; 206/806; 206/45.34

[58] Field of Search ..... 206/424, 472, 473, 474, 206/475, 806

[56] References Cited

U.S. PATENT DOCUMENTS

| | | | |
|---|---|---|---|
| 2,023,542 | 12/1935 | Peck | 206/806 X |
| 2,387,790 | 10/1945 | Williamson | 206/473 X |
| 4,020,947 | 5/1977 | Roccaforte | 206/806 X |
| 4,718,550 | 1/1988 | Johnson | 206/472 X |
| 4,724,957 | 2/1988 | Burgschweiger | 206/472 X |
| 4,771,886 | 9/1988 | Johnson | 206/472 |

FOREIGN PATENT DOCUMENTS

| | | | |
|---|---|---|---|
| 1344782 | 10/1963 | France | 206/806 |
| 2368368 | 5/1978 | France | 206/472 |
| 2091692 | 8/1982 | United Kingdom | 206/472 |

*Primary Examiner*—William Price

*Attorney, Agent, or Firm*—Welsh & Katz, Ltd.

[57] ABSTRACT

A reclosable book-like package is provided including inner and outer sheet-like portions, each having corresponding first and second leaves hinged to a central spine and sealed to each other along a common peripheral edge, the first and second leaves of the inner portion adapted to have formations designed to retain articles therein, the package is also provided with locking formation to releasably retain the leaves in a closed book position.

42 Claims, 4 Drawing Sheets

FIG. 6
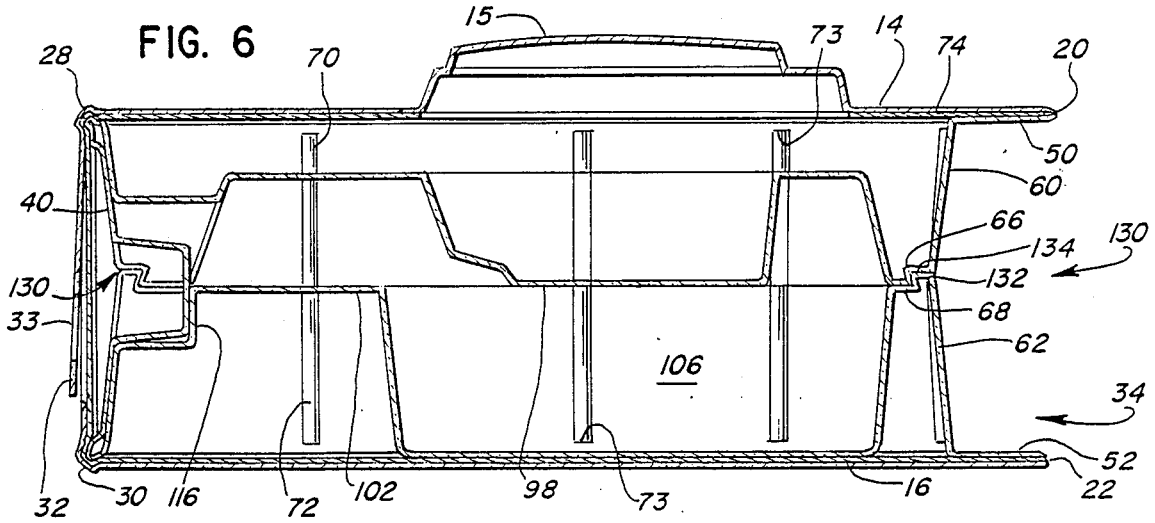
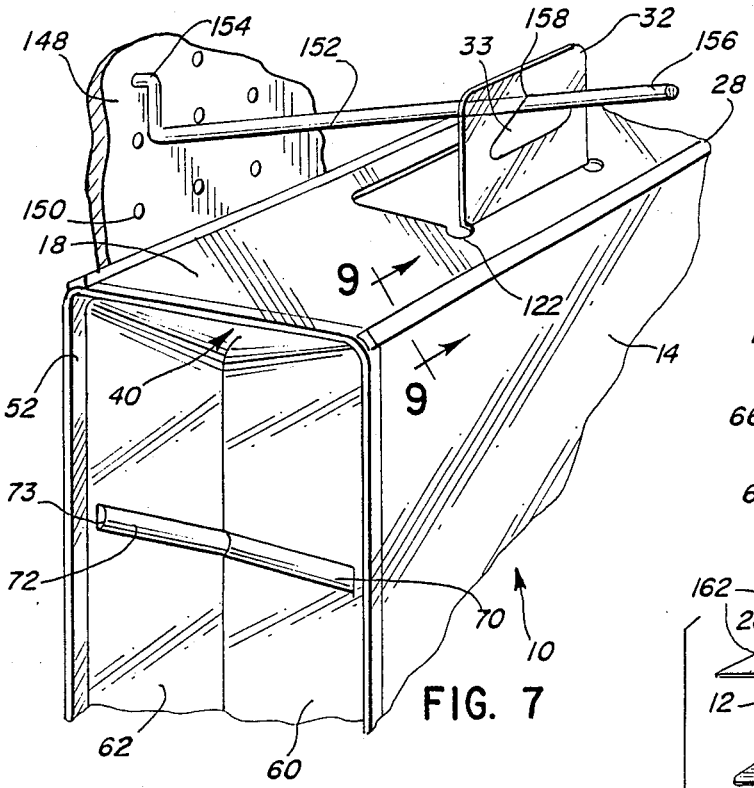
FIG. 7
FIG. 8
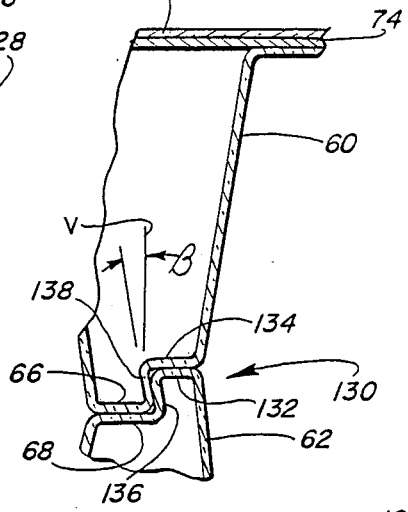
FIG. 10
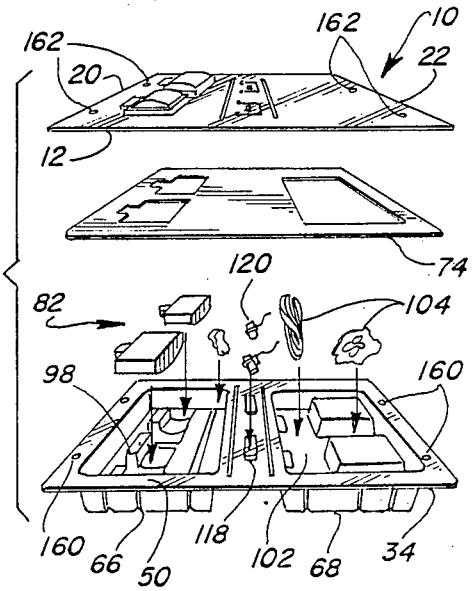
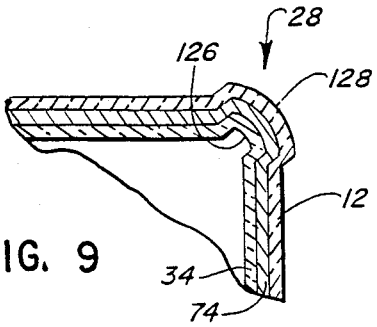
FIG. 9

RECLOSABLE BOOK-LIKE PACKAGE

BACKGROUND OF THE INVENTION

The present invention relates to packages generally used for the display of consumer goods on store shelves, and more particularly, to a transparent, reclosable package in book-like form, which may be repeatedly unfolded and reclosed in the store prior to purchase to permit visual examination of the packaged goods.

It is a common practice in self-service, minimum service and/or retail department stores to display goods provided in packaging which is attractive, durable enough to withstand shipping, which provides easily understandable information about the product and which protects the product from damage or theft by consumers.

In order to accomplish these objectives, retailers request and often demand that manufacturers provide goods in packaging which is designed to meet specific standards. In many cases, various forms of rigid, transparent, thermoformed plastic packages have been developed to achieve these goals. These include spherical, cubic or product-shaped plastic blisters which are secured to cards containing attractive graphics and product information. A major drawback of blisters is that the portion of the product directly opposite the graphic card is often not clearly visible to the consumer. An alternative package to blister and card combinations is a clam-shell blister, which provides substantially complete visibility of the product, but in this case, the graphics and product information must often be placed on a card which projects from the package and is easily disfigured or dislodged during shipping and/or handling by consumers, forcing the store owner to remove many products from the shelves merely because the packaging has been damaged through mishandling. A further disadvantage common to blister/card and clamshell blister packages is that they are often incapable of standing self-supported or in stacked fashion on a shelf, and must be hung from pegs on a wall. This limits the methods of product display, which are often critical to achieve marketing objectives.

In some product packaging applications, the above-identified disadvantages of conventional packages have been addressed by the use of a bifold clamshell package, which may be characterized as a clamshell blister split along a vertical plane into symmetrical front and rear portions and having a triangular side view configuration. The triangular configuration provides a relatively wide and stable base which enables the package to be self-supporting. Although the bifold package successfully resolves one disadvantage of conventional rigid plastic packaging, bifold packages still are inconvenient to stack for shipping due to the triangular shape and usually have minimum planar space for the display of graphic material. Furthermore, when packaging products in kit form or including a plurality of components and hardware, bifold clamshell packages do not allow for consumer visibility of many of the components. Alternatively, in packages where those components are visible, usually only one side is available for pre-purchase inspection. In addition, if the bifold package is split along its planar seam for inspection, the package components may escape from the package or may be easily pilfered.

Thus, there is a need for a rigid plastic package which is attractive, durable enough to withstand normal shipping, has a shape which facilitates packing, provides good visibility of substantially all sides of the package, is theft resistant, provides adequate planar surfaces for graphics and is self-supporting for display on store shelves.

SUMMARY OF THE INVENTION

Accordingly, the invention discloses a reclosable, book-like package having a substantially box-like configuration for ease of packing and handling and for optimum graphic and product display which opens like a book to enable inspection of substantially all sides of packaged articles prior to purchase, and which may be reclosed subsequent to inspection.

More specifically, the reclosable book-like package of the invention includes an inner portion with first and second leaves, each leaf hingedly affixed to a spine, the inner portion adapted to retain articles therein; an outer or cover portion having first and second leaves, each leaf hingedly affixed to a spine; and the inner and outer portions being sealed to each other so as to be in registry with each other, with the articles retained therebetween.

In addition, the package of the invention is provided with a novel, integral hinge design which facilitates repeated opening and closing of the package by consumers prior to purchase. The inner portion is provided with a variety of formations specifically adapted to retain the articles in substantially fixed positions, to provide a support function for the entire package, to enable the first and second leaves to be releasably locked to each other in the closed book position, and to provide internal support for printed graphic material.

BRIEF DESCRIPTION OF THE DRAWINGS

FIG. 6 is a sectional view taken along the line 6—6 of FIG. 3 and in the direction indicated generally;

FIG. 7 is a fragmentary perspective elevation of the package of FIG. 1 shown suspended on a wall;

FIG. 8 is an enlarged fragmentary sectional view of the locking mechanism of the package of the invention of FIG. 6;

FIG. 9 is fragmentary sectional view taken along the line 9—9 of FIG. 7 and in the direction indicated generally; and FIG. 10 is an exploded perspective elevation of the package of FIG. 1.

DESCRIPTION OF THE PREFERRED EMBODIMENT

Figure 1:
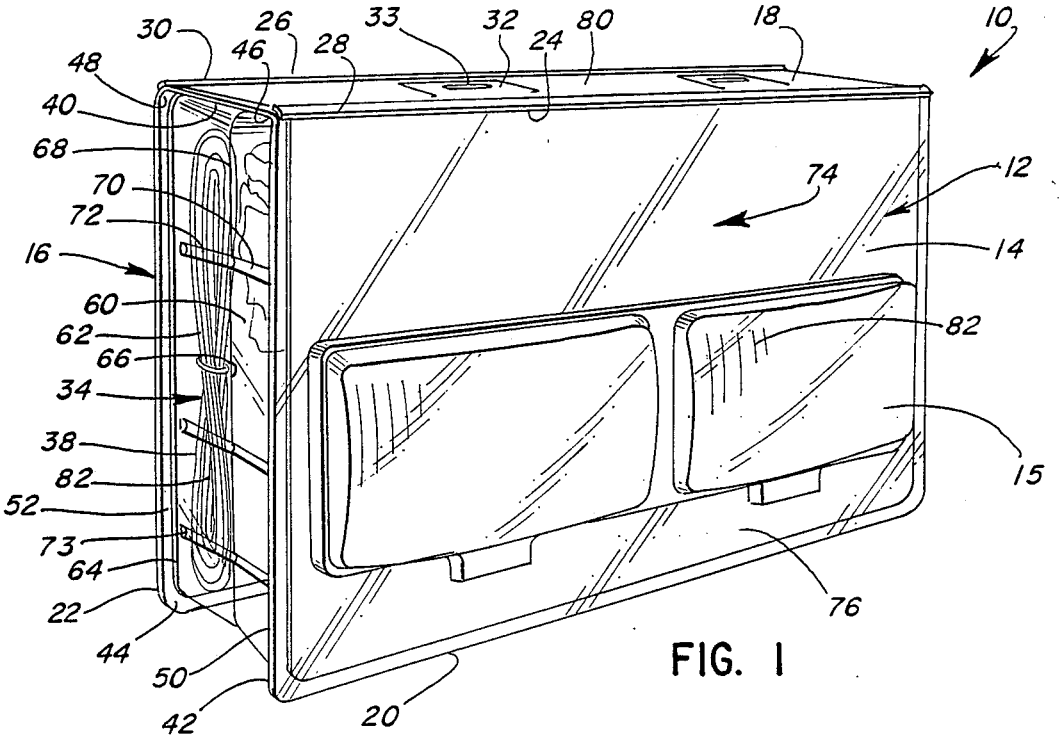
FIG. 1 is a front elevation in perspective of the reclosable book-like package of the invention.
Figure 2:
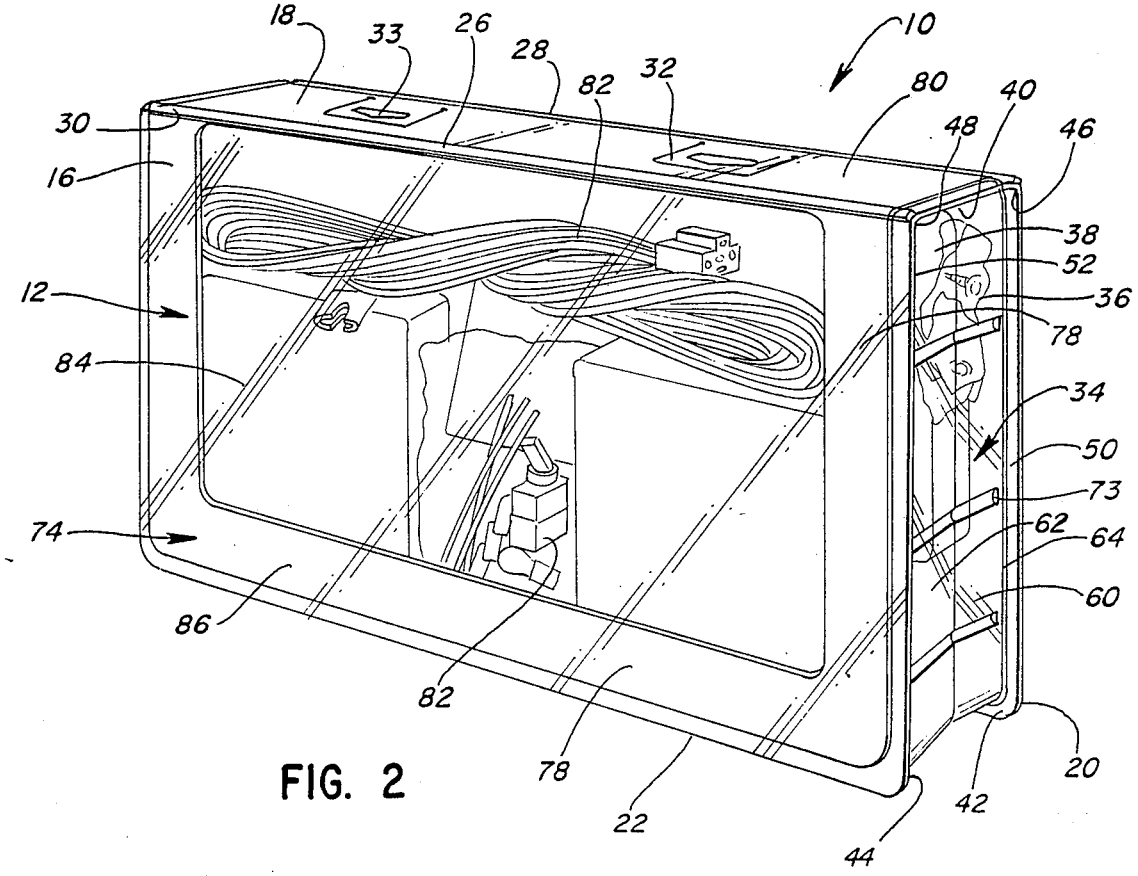
FIG. 2 is a rear elevation in perspective of the package depicted in FIG. 1.

Referring now to the drawings, wherein like reference numerals designate identical characteristics, FIGS. 1 and 2 depict the reclosable book-like package of the invention which is designated generally by the reference numeral 10. The package 10 includes an outer portion 12, preferably formed of a single sheet of transparent, rigid polymeric material such as polyvinyl chloride (PVC) or other suitable transparent, rigid thermoformable material. The outer portion 12 includes a first leaf 14, a second leaf 16 and a central spine 18. The first leaf 14 is shown with an outwardly projecting formation 15 which is created by thermoforming. The first and second leaves 14 and 16 are each provided with an outer peripheral edge margin 20, 22, respectively, and are also provided with an inner edge margin 24, 26, respectively. The inner edge margins 24 and 26 define the central spine 18 and are joined to the spine 18 by hinge joints 28 and 30. The spine 18 is further provided with at least one and peripherally two eyelet or lift tabs 32. The lift tabs 32 are preferably die cut into the outer portion 12 and are each provided with an aperture 33 which is adapted so that the package 10 may be suspended from suitable hooks or hook like devices for display on a store wall.

An inner portion 34 is sealingly secured to the outer portion 12 so that the two portions 12, 34 are in registry with each other. The inner portion 34 is also preferably fabricated of a single sheet of transparent, rigid thermoformable material such as PVC, and is substantially co-dimensional with the outer portion 12. The inner portion 34 includes a first inner leaf 36, a second inner leaf 38 and an inner spine 40. In similar fashion to the leaves 14 and 16 of the outer portion 12, the first and second inner leaves 36, 38 are each provided with an outer peripheral edge 42, 44, respectively and inner edges 46 and 48. The edges 46 and 48 are co-dimensional with the edges 24 and 26 and are also adapted to define the spine 40 of the inner portion 34.

The first and second leaf peripheral edges 42 and 44 of the inner portion 34 are each provided with an outer peripheral lip 50, 52, respectively which is adapted to be secured to the outer peripheral edges 20, 22 of the outer portion 12 preferably by conventional high frequency or radio frequency sealing apparatus. In addition, each of the first and second leaves 36, 38 of the inner portion 34 are provided with a recessed or inwardly projecting wall portion 60, 62. The peripheral recessed walls 60 and 62 are each provided with a somewhat tapered configuration so that a circumferential dimension measured around the base 64 of each wall 60, 62 is greater than a circumferential dimension of an inner peripheral edge surface 66 of the wall 60 which interfaces with a similar edge surface 68 of the wall 62. The wall portions 60, 62 are each provided with a like plurality of support dimples 70 and 72 respectively. Each dimple 70, 72 has a truncated end 73 adjacent the respective base 64. Each pair of corresponding dimples 70, 72 is positioned upon the wall portions 60, 62 to be substantially opposite and coaxial with each other when the wall portions 60, 62 of the first and second leaves are in locking engagement as is depicted in FIGS. 1–3.

In order to support the recessed wall foundations 60, 62 when the package 10 is in the closed position (best seen in FIGS. 1–3), the inner spine formation 40 may be provided in a substantially triangular or crowned configuration which corresponds with the tapered shape of the recessed wall formations 60, 62 (best seen in FIG. 6).

A graphics card 74 is provided, also having a first leaf portion 76, a second leaf portion 78 (best seen in FIG. 2) and a spine 80. The graphics card 74 is adapted to be inserted in sandwiched relationship between the outer portion 12 and the inner portion 34, and is normally fabricated of heavy printing stock, cardboard or other suitable material. The card 74 is provided with suitable printed advertising or graphic designs (not shown) to identify the source, price and/or the contents of the articles 82. The peripheral lips 50 and 52 of the inner portion 34 and the truncated ends 73 of the support dimples 70 and 72 are adapted to support the graphics card 74 and maintain its position within the package 10 so that the card does not become dislodged during shipment and/or repeated opening and reclosing of the package 10 prior to purchase.

Figure 3:
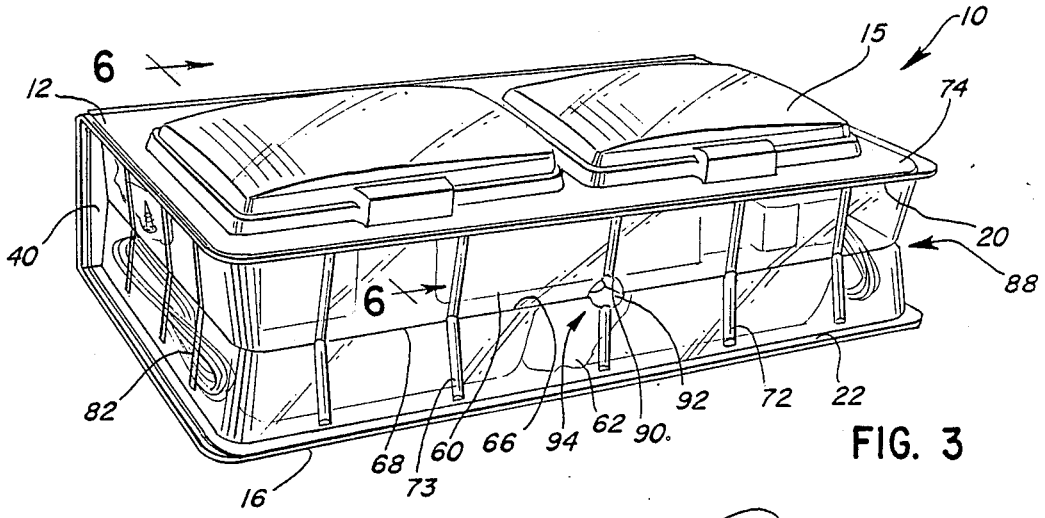
FIG. 3 is a perspective elevation showing the bottom of the package as depicted in FIG. 1.
Figure 4:
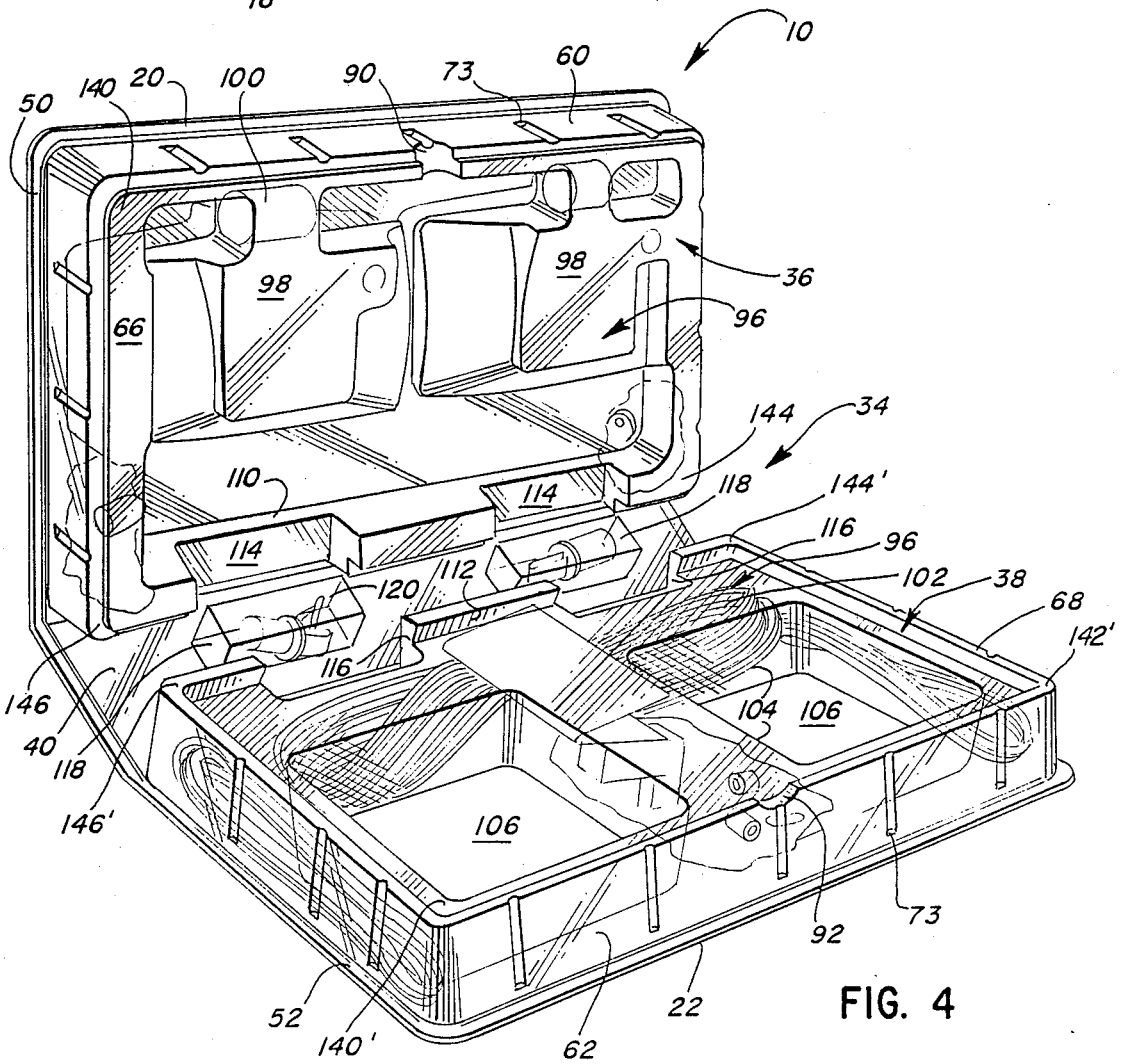
FIG. 4 is a perspective elevation showing the package of FIG. 1 in the partially opened position.

Referring now to FIG. 2, and to a lesser extent, FIGS. 1, 3 and 4, the package 10 is fabricated of substantially transparent materials to enable the potential purchaser to easily inspect the packaged products or articles 82 in the store prior to purchase. Furthermore, the configuration of the package 10 is designed so that several sides of the articles 82 are visible without breaking the sealed package. The graphics card 74 is provided on its second leaf portion 78 with a substantial cut-out portion 84, which essentially leaves the leaf 78 with only a peripheral margin 86. The margin 86 is used to support the card 74 within the package 10.

Referring now to FIG. 3, the package 10 is shown resting on the second leaf 16 of the outer portion 12 so that the bottom 88, located opposite the spine 18, is visible. The interfacing inner edges 66 and 68 of the respective recessed wall portions 60 and 62 are each provided with a semi-cylindrical recess 90 and 92, respectively, which, when the package 10 is in its closed position as shown in FIGS. 1–3, forms a substantially cylindrical finger bore 94. The finger bore 94 is adapted to accommodate the insertion of a human finger therein for the separation of the first and second leaves 36 and 38 of the inner portion 34 of the package 10. Although the finger bore 94 is preferably located in the bottom 88 of the package 10, it may alternately be located anywhere along the interfacing edges 66 and 68 of the recessed wall portions 60, 62.

Referring now to FIG. 4, the package 10 is shown in its unfolded or opened position, which represents how the package 10 appears after the customer has inserted a finger in the bore 94 to separate the interfacing edges 66 and 68. A significant advantage of the present invention is the ability of a prospective customer to observe various aspects of the articles 82 prior to purchase and without direct handling thereof. To achieve this end, the package 10 is designed so that when opened as depicted in FIG. 4, the customer may inspect the sides of the articles 82 which are opposite those visible when the package is closed.

FIG. 4 also illustrates that it is contemplated to provide the first and second inner leaves 36, 38 of the inner portion 34 with a variety of formations 96 which are specifically adapted to be form fit around the articles 82. In the preferred embodiment, the first leaf 36 is provided with a pair of receptacles 98 adapted to be form fit around the articles 82. Additional support formations 100 may be provided to add general structural support to the package 10 as well as to provide a protective air cushion around the articles 82. Alternatively, and referring now to the second leaf 38 of the inner portion 34, the formations 96 may include at least one pocket formation 102 adapted to enclose a plurality of relatively smaller articles 104. The leaf 38 as illustrated also includes a pair of symmetrical recesses 106 which define the configuration of the pocket portions 102 to be appropriately small enough so that the articles 104 are held securely within the package 10.

The recessed wall portions 60 and 62 are each provided with an inner wall segment 110 and 112, respectively. The inner wall segments 110 and 112 are each provided with at least one recessed portion 114, 116, respectively, the portions 114, 116 being located directly opposite each other. In the embodiment illustrated in FIG. 4, the recesses 114, 116 are located in each leaf 36, 38 of the inner portion 34. The function of the recessed portions 114, 116 is to accommodate at least one spine pocket formation 118, two of which are located in the inner spine 40. The spine pocket formations 118 are each integral with the inner spine portion 40 and project vertically therefrom into the areas defined by the recesses 114, 116. The spine pocket formations 118 are particularly well adapted for the packaging of relatively delicate articles 120 which may be susceptible to shock damage. The formations 118 provide additional shock protection in that the wall portions 60 and 62 provide an enclosure thereof of sealed in articles and air which insulates the formations 118 from unwanted impact which may damage the articles 120. In addition, when in the closed position as depicted in FIGS. 1–3, the transparent nature of the material used to fabricate the package 10 allows visual inspection of the articles 120 located within the formation 118 through the second leaf 16 (best seen in FIG. 2).

Figure 5:
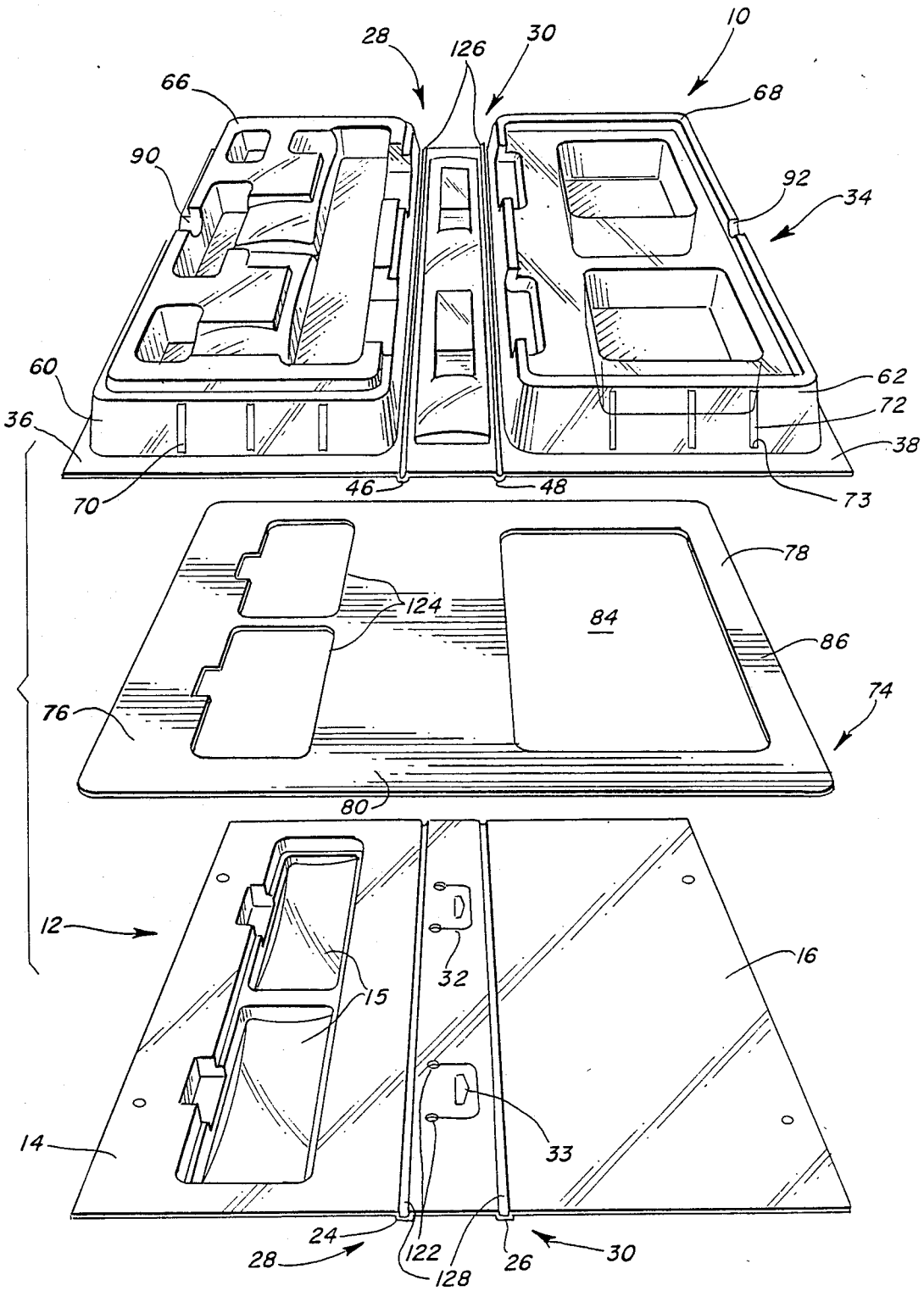
FIG. 5 is an exploded perspective elevation of the package of the invention as depicted in FIG. 4.

Referring now to FIG. 5, the package 10 as depicted in FIG. 4 is shown after the first leaf portion 14 and 36 have been folded flat and the package exploded to more easily view the components thereof. It will be readily seen that the outer portion 12 is fabricated of a substantially flat sheet of PVC material into which the lift tabs 32 are preferably formed by die cutting. The lift tabs 32 include the aperture 33 and a pair of vent holes 122 which prevent the build up of an undesirable air pressure within the package 10 subsequent to the sealing process, which, if unrelieved, tends to create an unsightly "balloon effect". In addition, the outer portion 12 may be provided with at least one specially designed, product form-fitted formation 15 in instances where the display of articles 82 projecting from the vertical plane of the first or second leaves 14 or 16 of the outer portion 12 are desired.

The graphics card 74 is shown as a substantially flat sheet of cardboard or other suitable opaque printable material, and is die cut to have the central cut out portion 84 and any additional product conforming portions 124 as may be desired by the manufacturer or the package designer.

The inner portion 34 begins as a substantially flat sheet in similar fashion to the outer portion 12. However, it is thermoformed on a mold which is often specially designed for the most advantageous display of the packaged articles or products. The configuration and location of the various formations 96 of the inner leaves 36 and 38 will be determined by the specific products to be packaged.

The configuration of the novel hinge joints 28 and 30 are seen in relatively clear detail in FIG. 5 as well as in FIGS. 6 and 9. The hinge joints 28 and 30 each include a pair of elongate folds 12 which extend the entire length thereof along the inner edges 46, 48, respectively of the inner portion 34. The hinges 28 and 30 further include a pair of corresponding outer folds 128 located along the edges 24 and 26 in the outer portion 12. Both the folds 126 and the folds 128 are integral with the respective inner and outer portions 34, 12 and are each adapted to accommodate the graphics card 74 sandwiched therebetween so that the package 10 will still be easily reclosed subsequent to inspection by the customer. Once the package 10 is assembled, the outer folds 128 are adapted to circumscribe the inner folds 126 and a corresponding portion of the card 74 to create a relatively durable hinge for the package 10 which enables the respective leaves 14 and 16 to readily close as is shown in FIGS. 1–3.

Referring now to FIGS. 6 and 8, the recessed wall portions 60 and 62 are adapted to be releasably secured to each other in locking condition by a snap fit locking mechanism designated generally by the reference numeral 130. The locking mechanism 130 includes a male lug formation 132 which is formed in the interfacing edge 68 and a corresponding female recessed formation 134 which is formed in the interfacing edge 66. The male and female formations 132, 134, respectively, are configured in a mating matching back draft formation as is commonly found in the packaging art. The matching back draft operates by providing a leading edge 136 of the lug portion 132 which, prior to closing of the package 10, is substantially directly opposite an edge 138 of the female recessed formation 134. The edge 138 in combination with the recess formation 134 defines an angle '$\beta$' in the edge 66. Also, the edge 136 in combination with the lug formation 132 defines a similar angle '$\beta$'. The angle '$\beta$' is preferably in the range of 5°–20° as measured from a vertical line 'V' 90° from the horizontal, and most favorable results have been obtained when '$\beta$' is approximately 10°.

The resilient configuration of the formations 132 and 134 are such that as pressure is exerted on the outer leaves 14 and 16 to close the package 10, the respective leading edges 136 and 138 are pushed past each other to create the releasable locking relationship depicted in FIGS. 6 and 8. It is preferred that back draft formations 130 be provided at least at the corners 140, 142, 144, and 146 and 140', 142', 144' and 146' of the recessed walls 60, 62 (best seen in FIG. 4). In the preferred embodiment, the back draft formation locking arrangement 130 is located around the entire interfacing edges 66, 68.

Referring now to FIG. 7, the package 10 of the invention is shown suspended on a display wall 148 of the type found in many self-service and limited service stores. The display wall 148 is shown as a sheet of peg board having a plurality of regularly spaced bores 150. A conventional peg board hook 152 is inserted into the bore 150 at a specialty adapted end 154 thereof. To suspend the package 10 from the hook 152, each of the lift tabs 32 is moved so as to be in a vertically projecting position relative to the spine 18. The aperture 33 is then inserted over the free end 156 of the hook 152. In the preferred embodiment, the aperture 33 is defined by a triangular cutout of the tab 32 and includes an apex 158 designed to accommodate the hook 152. It will be evident that a sufficient number of lift tabs 32 and corresponding peg board hooks 152 will be provided to adequately balance and support the weight of the package 10.

Referring now to FIG. 10, the package 10 is illustrated in exploded format to depict the preferred sequence of assembly. Once the outer and inner portions 12 and 34 are thermoformed into their desired configurations, the inner portion 34 is positioned to rest upon the interfacing edge margins 66 and 68 so that the formations 98, 102 and 118 open upwardly. The articles 82, 104 and 120 to be packaged are then placed in the designated pocket formations. Next the graphics card 74 is positioned upon the products and rests upon the lips 50, 52, which, prior to final assembly are provided with an extra wide periphery having integrally molded register buttons 160 to facilitate the proper location of the outer portion 12 thereon. The outer portion 12 is also provided with extra wide peripheral edges 20, 22 and a plurality of register buttons 162 adapted to matingly engage the buttons 160.

Once the articles 82 are located within the inner portion 34, the graphics card 74 is located thereupon, the outer portion 12 is placed in registry with the inner portion 34, and the portions 12 and 34 are sealed together, preferably by radio frequency sealing. As a final step, the extra wide periphery, including registry buttons 160, 162 is removed.

While particular embodiments of this package have been shown and described, it will be obvious to persons skilled in the art that changes and modifications might be made without departing from the invention in its broader aspects.

What is claimed is:

1. A package adapted to be opened and closed like a book, comprising:

a transparent inner portion including a first leaf, a second leaf and a spine, said leaves each having an inner edge margin hinged to a corresponding edge of said spine, said inner portion having at least one formation for retaining articles therein;

a transparent outer portion, including a first leaf, a second leaf and a spine, said leaves each having an inner edge margin hinged to a corresponding edge of said spine; and means for sealing said inner portion to said outer portion so that said first leaves, said second leaves and said spines of said inner and outer portions are in register with each other and the articles may be enclosed within said at least one formation and between said inner and outer portions, and may be visually inspected by opening and closing said leaves of said package without breaking the seal.

2. The package defined in claim 1 further including means for releasably fastening said sealed leaves of said package to each other.

3. The package defined in claim 2 wherein said fastening means are located on said first and second leaves of said inner portion.

4. The package defined in claim 3 wherein said fastening means include a lugged portion of said first leaf and a recessed portion on said second leaf, said lugged and recessed portions being adapted to engage each other.

5. The package defined in claim 4 wherein said lugged and recessed fastening means is at least one matching back draft.

6. The package defined in claim 5 wherein said first and second leaves of said inner portion each have a polygonal configuration with a plurality of corners, said matching back draft formation being located at least at each of said corners.

7. The package defined in claim 6 wherein said leaves are substantially rectangular.

8. The package defined in claim 1 wherein said at least one formation includes a transparent pocket located on said first leaf of said inner portion.

9. The package defined in claim 8 wherein said at least one formation includes a transparent pocket located on said second leaf of said inner portion.

10. The package defined in claim 9 wherein said at least one formation includes a transparent pocket located on said spine of said inner portion.

11. The package defined in claim 10 wherein said pocket formations on said first and second leaves are arranged so that said pocket on said spine may rest therebetween when said package is closed, and articles retained in said spinal pocket may be visible from the exterior of said package.

12. The package defined in claim 1 wherein said outer portion is a substantially planar sheet.

13. The package defined in claim 1 wherein said inner and outer portions are sealed by said sealing means around the respective outer peripheral edge margins thereof.

14. The package defined in claim 13 wherein said sealing means is a radio-frequency seal.

15. The package defined in claim 1 where said inner and outer portions are fabricated of rigid plastic.

16. The package defined in claim 15 wherein said plastic is PVC.

17. The package defined in claim 1 wherein said spine of said outer portion is provided with means for suspending said package.

18. The package defined in claim 17 wherein said suspending means is at least one lift tab.

19. A foldable book-like package comprising:

a transparent inner portion, including a first leaf, a second leaf, a spine and hinge means, said leaves each having an inner edge margin adapted to be joined to a respective edge margin of said spine by said hinge means, said inner portion having a plurality of formations adapted to retain articles therein;

a transparent outer portion, including a first leaf, a second leaf, a spine and hinge means, said leaves each having an inner edge margin adapted to be joined to a respective edge margin of said spine by said hinge means;

sealing means for sealing said inner portion to said outer portion along opposing outer peripheral edge margins thereof so that said leaves, said spines and said hinge means are in register with each other, and the articles are enclosable within said formations and between said inner and outer portions, and may be substantially visually inspected by opening and closing said leaves of said package without breaking the seal.

20. The package defined in claim 19 wherein said hinge means on said inner portion is a pair of elongate integral folds, one located on each side edge of said spine, each said fold co-dimensional with said inner edge margin of said next adjacent leaf.

21. The package defined in claim 20 wherein said hinge means on said outer portion is a pair of elongate folds, one on each side edge of said spine, each said fold being co-dimensional with said inner edge margin of each of said leaves and integral with said spine and said first and second leaves; said folds on said outer portion being adapted to circumscribe said corresponding folds of said inner portion.

22. The package defined in claim 21 further including a graphics card adapted to be sandwiched between said inner and outer portions, including said respective hinge means.

23. The package defined in claim 19 wherein said sealing means is a radio-frequency induced seal.

24. The package defined in claim 19 wherein said inner portion is a substantially planar sheet with at least one recessed formation therein.

25. The package defined in claim 24 wherein said first and second leaves of said inner portion each have at least one recessed formation therein.

26. The package defined in claim 25 wherein said recessed formations of said first and second leaves each define a wall which is substantially co-dimensional with said respective leaves, said wall having inner and outer peripheral edge margins.

27. The package defined in claim 26 wherein said respective inner peripheral edge margins of said walls on said first and second leaves are provided with fastening means to releasably retain said package in a closed-book position.

28. The package defined in claim 27 wherein said fastening means is matching back draft formation.

29. The package defined in claim 26 wherein each of said walls on said first and second leaves is tapered from said outer peripheral edge to said inner peripheral edge.

30. The package defined in claim 29 wherein said walls are each provided with a plurality of support dimples.

31. The package defined in claim 30 wherein said support dimples are located upon said wall in parallel, spaced relation to each other.

32. The package defined in claim 31 wherein said dimples each have an upper end and a lower end, said upper end being located in close proximity to said outer peripheral margin of said wall and adapted to support a graphic card thereon.

33. The package defined in claim 32 wherein said recessed formation of said spine is adapted to retain at least one packaged article therein.

34. The package defined in claim 29 wherein said spine of said inner portion has a recessed formation adapted to engage said tapered wall portions of said first and second leaves when said package is closed.

35. The package defined in claim 34 wherein said recessed formation on said spine is substantially triangular in section.

36. The package defined in claim 35 wherein said recessed spine formation is adapted to retain at least one packaged article therein.

37. The package defined in claim 36 wherein said recessed spine formation includes at least one box-shaped pocket.

38. The package defined in claim 37 wherein said walls of said first and second leaves of said inner portion are each adapted to matingly engage said box-shaped portion therebetween when said package is closed.

39. The package defined in claim 26 wherein said walls of said first and second leaves are adapted to interface each other along opposing planar surfaces when said package is closed.

40. The package defined in claim 38 wherein said walls are provided with opening means.

41. The package defined in claim 39 wherein said opening means is located along said opposing planar surfaces.

42. The package defined in claim 40 wherein said opening means is at least one finger bore adapted to be bisected by said opposing planar surfaces.

* * * * *

UNITED STATES PATENT AND TRADEMARK OFFICE

CERTIFICATE OF CORRECTION

PATENT NO. : 4,892,195

DATED : January 9, 1990

INVENTOR(S) : Daniel J. Slavin et al.

It is certified that error appears in the above-identified patent and that said Letters Patent is hereby corrected as shown below:

On the cover page, in the Abstract, line 8, delete "formation" and insert --formations--;

Column 5, line 59, delete "12" and insert --126--;

and

Column 7, line 52, after "draft", insert --formation--.

Signed and Sealed this

Nineteenth Day of March, 1991

*Attest:*

HARRY F. MANBECK, JR.

*Attesting Officer*

*Commissioner of Patents and Trademarks*